US008939057B1

(12) United States Patent
Edsall

(10) Patent No.: US 8,939,057 B1
(45) Date of Patent: Jan. 27, 2015

(54) FIREARM SUPPRESSOR

(71) Applicant: Richard A. Edsall, Ashton, MD (US)

(72) Inventor: Richard A. Edsall, Ashton, MD (US)

( * ) Notice: Subject to any disclaimer, the term of this patent is extended or adjusted under 35 U.S.C. 154(b) by 0 days.

(21) Appl. No.: 14/024,693

(22) Filed: Sep. 12, 2013

(51) Int. Cl.
*F41A 21/00* (2006.01)
*F41A 21/30* (2006.01)

(52) U.S. Cl.
CPC ..... *F41A 21/30* (2013.01)
USPC ..... 89/14.05; 89/14.4; 181/223

(58) Field of Classification Search
CPC ..... F41A 21/30
USPC ..... 89/14.05, 14.4; 181/223
See application file for complete search history.

(56) References Cited

U.S. PATENT DOCUMENTS

| | | | | | |
|---|---|---|---|---|---|
| 1,017,003 | A | * | 2/1912 | Kenney | 181/223 |
| 1,081,348 | A | * | 12/1913 | Unke | 181/264 |
| 1,111,202 | A | | 9/1914 | Westfall | |
| 1,127,250 | A | | 2/1915 | Humm | |
| 1,773,443 | A | | 8/1930 | Wilman | |
| 2,442,773 | A | * | 6/1948 | Mason | 181/223 |
| 2,448,382 | A | | 8/1948 | Mason | |
| 3,368,453 | A | * | 2/1968 | Shaw | 89/14.3 |
| 3,385,164 | A | | 5/1968 | Etal | |
| 3,713,362 | A | | 1/1973 | Charron | |
| 3,748,956 | A | * | 7/1973 | Hubner | 89/14.4 |
| 4,176,487 | A | | 12/1979 | Manis | |
| 4,530,417 | A | | 7/1985 | Daniel | |
| 4,576,083 | A | * | 3/1986 | Seberger, Jr. | 89/14.4 |
| 4,588,043 | A | * | 5/1986 | Finn | 181/223 |
| 4,785,909 | A | | 11/1988 | Young | |
| 4,907,488 | A | * | 3/1990 | Seberger | 89/14.4 |
| 5,029,512 | A | | 7/1991 | Latka | |
| 5,164,535 | A | | 11/1992 | Leasure | |
| 5,679,916 | A | | 10/1997 | Weicher | |
| 6,109,387 | A | | 8/2000 | Boretti | |
| 6,308,609 | B1 | | 10/2001 | Davies | |
| 6,796,214 | B2 | | 9/2004 | Hausken | |
| 7,832,323 | B1 | * | 11/2010 | Davies | 89/14.4 |
| 7,870,815 | B2 | * | 1/2011 | Hung | 89/14.2 |
| 8,579,075 | B2 | * | 11/2013 | Brittingham et al. | 181/223 |
| 8,584,794 | B2 | * | 11/2013 | Dueck | 181/223 |
| 2004/0079221 | A1 | | 4/2004 | Woods et al. | |
| 2012/0145478 | A1 | * | 6/2012 | Brittingham | 181/223 |
| 2012/0180624 | A1 | * | 7/2012 | Troy et al. | 89/14.4 |

* cited by examiner

*Primary Examiner* — Michelle R Clement
(74) *Attorney, Agent, or Firm* — Lieberman & Brandsdorfer, LLC

(57) ABSTRACT

Embodiments of the invention relate to a dynamic suppression mechanism for a firearm. Multiple chambers are aligned within a housing, with adjacently positioned chambers separated by a partition. A central aperture is provided within the partition(s) to accommodate the projectile and form part of the projectile path, and multiple relief ports are annularly arranged around the central aperture. As the projectile travels through the path and through the length of the housing, the relief ports use gas byproduct released from the projectile as an elastic medium to muffle concussive forces and mitigate flash as the projectile is released from the body.

18 Claims, 12 Drawing Sheets

FIREARM SUPPRESSOR

FIELD OF THE INVENTION

The present invention relates to a firearm apparatus and a method for suppressing noise associated with movement of a projectile. More specifically, the present invention mitigates noise associated with the projectile as it travels through a tubular housing of the firearm during discharge.

BACKGROUND

Firearms function by discharging a projectile through associated firearm housing. During use, a projectile travels through the housing at an accelerated speed and then discharges to a target or target vicinity. One byproduct of the projectile traveling through the housing is noise. It is known in the art to employ a suppressor, also known as a silencer, to reduce the noise associated with the projectile discharge. Various configurations have been employed to reduce noise.

SUMMARY OF THE INVENTION

The present invention relates to an apparatus and method for mitigating noise associated with discharge of a projectile from a firearm.

In one aspect of the invention, an apparatus is provided with a tubular housing secured to a muzzle end of a firearm. The tubular housing defines a hollow interior that surrounds a path along which a projectile can travel when subject to discharge. More specifically, the tubular housing has two ends defined as a first end and a second end. The first end is secured to the muzzle end of the firearm, and the second end is oppositely disposed. Within the tubular housing there are multiple volume chambers that extend from the first end to the second end. Adjacently positioned chambers are separated by a partition, with each partition having an aperture to receive the projectile, and multiple relief ports axially disposed about the partition.

Other features and advantages of this invention will become apparent from the following detailed description of the presently preferred embodiments of the invention taken in conjunction with the accompanying drawings.

Figure 1:
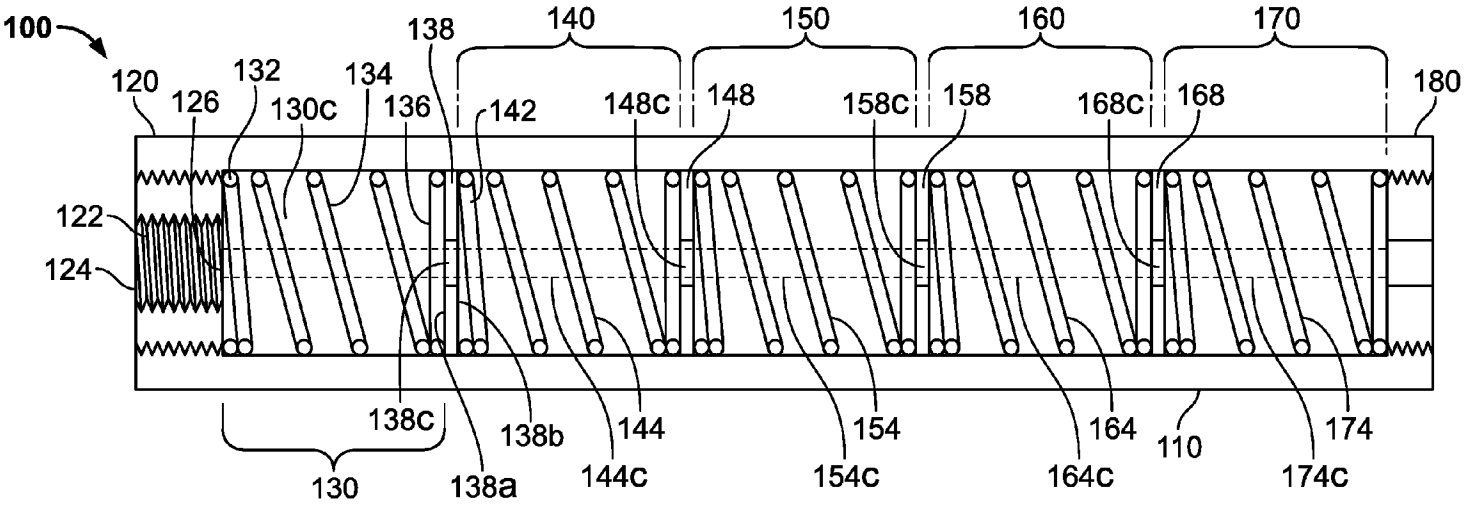
FIG. 1 is a sectional view of one embodiment of a noise suppressor for a firearm.

The drawings referenced herein form a part of the specification. Features shown in the drawings are meant as illustrative of only some embodiments of the invention, and not of all embodiments of the invention unless otherwise explicitly indicated. Implications to the contrary are otherwise not to be made.

DETAILED DESCRIPTION

As noted, suppression of noise from a firearm is not a new concept. Different configurations are known in the art for suppressing noise associated with discharge, with the configurations based on the design and size of the firearm. Noise associated with discharge of a projectile from a high powered rifle can be excessive, and suppression of the noise is challenging due to the configuration of the weapon.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of noise supporting elements for a firearm and an associated projectile associated therewith to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

A noise suppressor for a firearm utilizing concepts of the invention is illustrated in FIG. 1. More specifically, FIG. 1 is a sectional view of one embodiment of the noise suppressor (100). The suppressor includes an annular shaped body (110) having a first end (120) and a second end (180). The first end (120) includes a threaded interior wall (122) configured to be secured to threads of a barrel of a firearm (not shown). In one embodiment, the first end (120) may be alternatively configured and secured to the barrel of the firearm. The threaded interior wall (122) is one embodiment that may be employed for the securement. As shown, the threaded wall (122) has an annular aperture (124) that extends from the first end (120) to an interior second end (126). The size of the aperture is configured with a diameter that is greater than the diameter of a projectile exiting from the barrel of the firearm. Accordingly, the threaded interior wall is configured to secure to the barrel of the firearm and sized to receive a projectile exiting the barrel.

The threaded interior wall (122) is shown adjacent to the first end (120) of the annular shaped body (110). The second interior end (126) of the threaded wall is adjacently position to a first dynamic volume chamber (130). In the example shown herein, there are five dynamic volume chambers (130), (140), (150), (160), and (170). The first dynamic volume chamber (130) is adjacently mounted to the threaded wall (122), and the fifth dynamic volume chamber (170) is mounted adjacent to the second end (180). Although five dynamic volume chambers are shown, the invention should not be limited to this quantity. In one embodiment, the suppressor may be limited to two or more dynamic volume chambers. Accordingly, multiple dynamic volume chambers are provided within the body of the suppressor.

Each dynamic volume chamber is identical to an adjacently mounted dynamic volume chamber, and will be described herein with specificity with respect to the first dynamic volume chamber (130). As shown, the dynamic volume chamber (130) includes a hydraulic absorbing material (134) that extends the length of the chamber. In one embodiment, the absorbing material is any material configured to absorb shock and sound, i.e. compression and rarefaction of ambient gas. More specifically, each chamber (130) has a first end (132) and a second end (136). With respect to the first chamber (130), the first end (132) is adjacent to and in communication with the threaded wall (122) and the second end (136) defines the distal boundary of the chamber (132). A separator (138) is provided adjacent to the distal boundary of the first chamber (130). The separator (138) is in communication with the first end (132) of a first absorbing material (134) on a first side (138*a*) of the separator (138) and is in communication with a first end (142) of a second absorbing material (144) on a second side (138*b*) of the separator (138).

Each absorbing material and each adjacently mounted separator is configured and aligned with an aperture sized to receive a projectile. More specifically, the first absorbing material (134) of the first chamber (130) is configured with aperture (130*c*), and separator (138) is configured with aperture (138*c*). Both of these apertures (130*c*) and (138*c*) are at or near the same diameter and are aligned together and with the aperture of the threaded wall (122). Each of the sequential chambers (140)-(170) are configured with separate absorbing materials (144), (154), (164), and (174) respectively, with each absorbing material configured with an aperture (144*c*), (154*c*), (164*c*), and (174*c*), respectively. Accordingly, a projectile discharged from the firearm may travel an axial path formed by the aligned apertures through the body (110).

As shown in the example herein, there are five dynamic volume chambers, with the fifth chamber (170) being the furthest disposed from the firearm. The fifth chamber (170) includes an adjacently mounted exit (180). Upon completion of travel of the projectile through the fifth chamber, the projectile will exit the body (110) through the exit (180).

Each of the dynamic volume chambers (130)-(170) illustrated in FIG. 1 are shown in a rest state wherein the absorbing material is compressed. In one embodiment, the absorbing material may be in the form of a spring or an elastomer, or any material that is axially variable, i.e. changes shape along an axis, with the rest state including the absorbing material in a compressed state. As the projectile enters the first chamber (130), the absorbing material de-compresses and expands thereby causing movement of the first separator (138) in a lateral direction. In one embodiment, the body (110) is comprised of a non-expanding material; as such the expansion limits of each absorbing material are limited to the lateral direction. The projectile travels through the body one chamber at a time. As the projectile exits the first chamber (130), the absorbing material returns to a rest state, i.e. compressed form, and moves in the process, while the second chamber (140) receives the projectile with the second spring (132) de-compressing as the projectile travels through the second chamber. Each separator (138), (148), (158), and (168) is sized so that an exterior edge is in communication with an interior wall of the body (110). As such, as each separator (138)-(178) is subject to axial movement associated with compression and de-compression of the absorbing material, debris that is in communication with the interior wall of the body (110) is removed from the wall.

As the projectile travels through the body (110) and each chamber therein (130)-(170), the projectile emits a byproduct. In one embodiment, the byproduct is a gas emitted by the projectile. Similarly, in another embodiment, the byproduct may include percussive energy, sound energy, and/or shock from the projectile. In both forms, the byproduct causes an expansion of the hydraulic absorbing material that extends the length of the associated chamber. Once the projectile exits the chamber, the material returns to an equilibrium state, i.e. compressed. Accordingly, the byproduct of the projectile causes the hydraulic absorbing material to change from a compressed state to an expanded state, and then to return to the compressed state upon discharge of the projectile.

Figure 2:
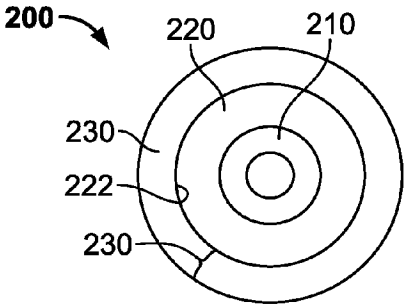
FIG. 2 is a front view of the suppressor shown in FIG. 1.

FIG. 2 is a front view (200) of the suppressor shown in FIG. 1. As shown, there are three concentric sections (210), (220), and (230). Starting from an interior portion of the suppressor, the first concentric section (210) represents the path of the projectile through the length of the suppressor. The path is formed by a combination of the chambers. More specifically, as shown in FIG. 1, each chamber is comprised of a separator and an absorbing material, with an aperture formed in both the separator and the absorbing material. Each separator is aligned with adjacently positioned absorbing material so that the apertures are aligned. Specifically, the separator of a chamber is aligned with the absorbing material in the chamber, as well as aligned with the absorbing material in an adjacently positioned chamber. This alignment and positioning of the separator with the absorbing material formed the path of the projectile as represented by the first concentric section (210).

As shown in FIG. 2, in addition to the first section (210), there are second and third sections (220) and (230), respectively. The second section (220) represents a width of an interior compartment of the suppressor. Each chamber and each separator have a width that extends the size of the width of the interior compartment. As described above in FIG. 1, as the chambers expand and contract, the separators are subject to movement with the adjacently positioned material. During this movement, the outside edge of each of the separators is in contact with an interior wall, as represented at (222), and this contact and movement effectively enables the separator to clean the residue created by the projectile and/or absorbing material from the interior wall (222). Accordingly, the second section (222) represents the width of the interior compartment of the suppressor.

The third concentric section (230) represents the exterior wall of the suppressor and its associated width. More specifically, the suppressor has an exterior wall that has a width that extends to the outermost side of the second section (220). The suppressor has a defined width to support housing the components or each compartment as well as functioning to mitigate noise by-product associated with travel of the projectile from the firearm and through the length of the suppressor.

In the embodiments shown in FIGS. 1 and 2, the suppressor is shown with five chambers, and each of the chambers including hydraulic absorbing material. The suppressor may include a minimum of one chamber, or expanded to include two or more additional chambers. The absorbing material may include a variety of material. In one embodiment, the absorbing material is in the form of a spring with each spring to extend the length of the chamber in which it is housed. In one embodiment, the material of the spring enables the spring or any material that absorbs compression and rarefaction of gas may withstand a temperature up to 550 degrees Fahrenheit. The separators, one per chamber, may be in the form of a washer, machined annular sleeve, ring of metal, etc., with each separator having an aperture sized to receive the projectile and a width sized to the width of the chamber so that the separator may remove debris that forms along the interior wall of the suppressor.

Figure 3:
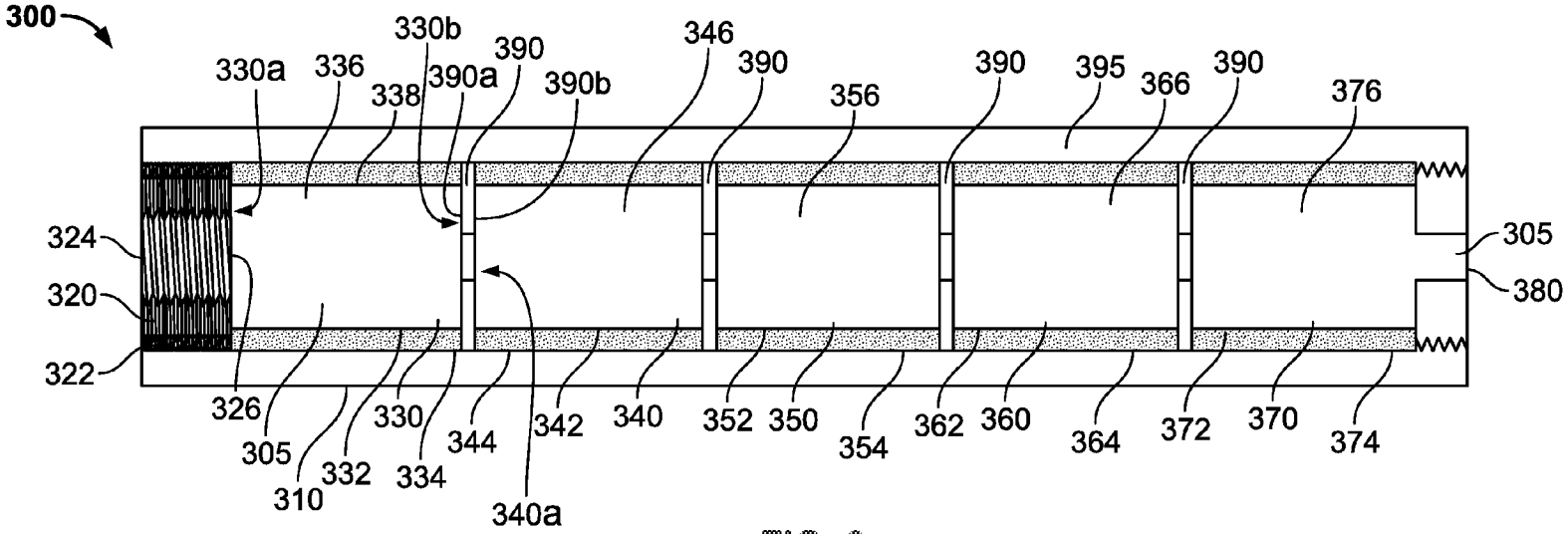
FIG. 3 is a sectional view of another embodiment of a noise suppressor for a firearm.

FIG. 3 is a sectional view of another embodiment of a noise suppressor (300) for a firearm. The suppressor includes an annular shaped body (310) having a first end (320) and a second end (380). An annular shaped aperture (305) is formed through the body (310) to accommodate noise suppression materials. In one embodiment, the body (310) is comprised of an aluminum material. The first end (320) includes a threaded interior wall (322) configured to be secured to threads of a barrel of a firearm (not shown). In one embodiment, the first end (320) may be alternatively configured and secured to the barrel of the firearm. The threaded interior wall (322) is one embodiment that may be employed for the securement. As shown, the threaded wall (322) has an annular aperture (324) that extends from the first end (320) to an interior second end (326). The size of the aperture is configured with a diameter that is greater than the diameter of a projectile exiting from the barrel of the firearm. Accordingly, the threaded interior wall is configured to secure to the barrel of the firearm and sized to receive a projectile exiting the barrel.

The threaded interior wall (322) is shown adjacent to the first end (320) of the annular shaped body (310). The second interior end (326) of the threaded wall is adjacently position to a first chamber (330) of a series of chambers. In the example shown herein, there are five chambers (330), (340), (350), (360), and (370). The first chamber (330) is adjacently mounted to the threaded wall (322), and the fifth chamber (370) is mounted adjacent to the second end (380). Although five chambers are shown, the invention should not be limited to this quantity. In one embodiment, the suppressor may be limited to two or more chambers. Each chamber has a sleeve, with each sleeve having an interior wall (332), (342), (352), (362) and (372) and an exterior wall (334), (344), (354), (364), and (374). Each of the interior walls is adjacent to an interior area of the chamber (336), (346), (356), (366), and (376); each of the exterior walls of the respective sleeves (334)-(374) are adjacently positioned to the annular shaped aperture (305) of the body (310). Accordingly, multiple chambers are positioned within the body of the suppressor.

Each chamber is identical to an adjacently mounted chamber, and will be described herein with specificity with respect to the first chamber (330). As shown, the chamber (330) includes an exterior wall sleeve (332) comprised of a material (338) to absorb compression and rarefaction of ambient gas, hereinafter referred to as an absorbing material, that extends the length of the chamber. In one embodiment, the absorbing material of the exterior wall may be in the form of a polyurethane, neoprene or silicon material. Each chamber (330) has a first end (330*a*) and a second end (330*b*). With respect to the first chamber (330), the first end (330*a*) is adjacent to and in communication with the threaded wall (322) and the second end (330*b*) defines the distal boundary of the chamber (332). A separator (390) is provided adjacent to the distal boundary of the first chamber (330). In one embodiment, the separator (390) is comprised of a stainless steel or aluminum material. The separator (390) is in communication with the second end (330*b*) of the first chamber (330) on a first side (390*a*) of the separator (390) and is in communication with a first end (340*a*) of the second chamber (340) on a second side (390*b*) of the separator (390). As shown, a separator (390) is provided between each set of adjacently position chambers.

Alignment of the multiple chambers (330)-(380), each comprised of a fluid responsive material encased within the annular shaped body (310), effectively forms a tube (395). The material may be in the form of polyurethane, neoprene, silicone rubber, or other fluid responsive material. In one embodiment, the material may withstand a temperature up to 500 degrees Fahrenheit. Each adjacently mounted chamber is separated by a separator. The configuration of the tube (395), including the material composition, provides flash suppression for a projectile traveling through the tube (395). The separators are each comprised of stainless steel, or an alternative material, that is resistive of high temperatures and flash associated with travel of the projectile. Each of the chambers (330)-(380), and more specifically, the respective separators, are adjacently mounted and aligned with an aperture sized to receive the projectile. Accordingly, a projectile discharged from the firearm may travel an axial path formed by the aligned apertures through the body (310).

As shown in the example herein, there are five chambers, with the fifth chamber (370) being the furthest disposed from the firearm. The fifth chamber (370) includes an adjacently mounted exit (380). Upon completion of travel of the projectile through the fifth chamber, the projectile will exit the body (310) through the exit (380). As the projectile travels through the chambers, the projectile emits a byproduct, such as gas, percussive energy, sound energy, flash, etc. The byproduct causes an expansion of the hydraulic absorbing material of the chamber walls, e.g. polyurethane, neoprene, or silicone rubber polymer. Once the projectile exits the chamber, the hydraulic absorbing material returns to an equilibrium state, i.e. compressed. Accordingly, the byproduct of the projectile causes the hydraulic absorbing material to change from a compressed state to an expanded state, and then to return to the compressed state upon discharge of the projectile.

Each separator (390) is subject to axial movement along the length of its respective chamber. In one embodiment, the absorbing material that lines the chamber is in a compressed state at equilibrium and de-compresses when the projectile travels through the chamber. The axial movement of the separator (390) is associated with compression and de-compression of the absorbing material. Debris does not accumulate on the interior walls of the chamber. In one embodiment, the characteristics of the material do not enable debris to adhere to the surface. The debris associated with any projectile byproduct exits the chamber through the same aperture as the projectile. As such, there is no need for a cleaning of the interior walls of the chamber(s).

Figure 4:
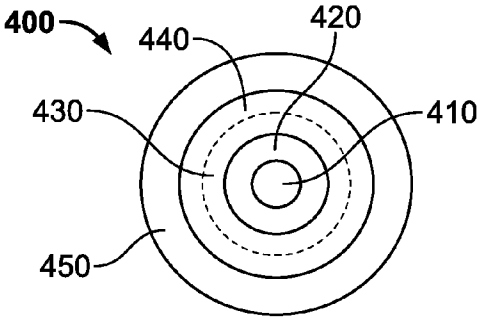
FIG. 4 is an end view of the noise suppressor shown in FIG. 3.

FIG. 4 is an end view (400) of the noise suppressor shown in FIG. 3. As shown, there are five concentric sections (410), (420), (430), (440), and (450). Starting from an interior portion of the suppressor, the first concentric section (410) represents the path of the projectile through the openings in each of the partitions. The path is formed by a combination of the chambers and their associated partitions. Each adjacent chamber is aligned by the annular shaped aperture (305) such that the partitions and their associated apertures are aligned. The second concentric section (420) represents the diameter of the threaded opening that secures the suppressor body to the firearm. The third concentric section (430) represents an interior wall of each of the chambers, with the fourth concentric section (440) representing an end view of the silicon elastomer section. The fifth concentric section (450) represents an exterior wall of the suppressor body (310). Accordingly, as shown herein, each of the components of the suppressor have an annular representation and are aligned to form a path for travel of a projectile exiting the firearm, with the materials of the components functioning to suppress both noise and flash associated with the projectile travel.

Figure 5:
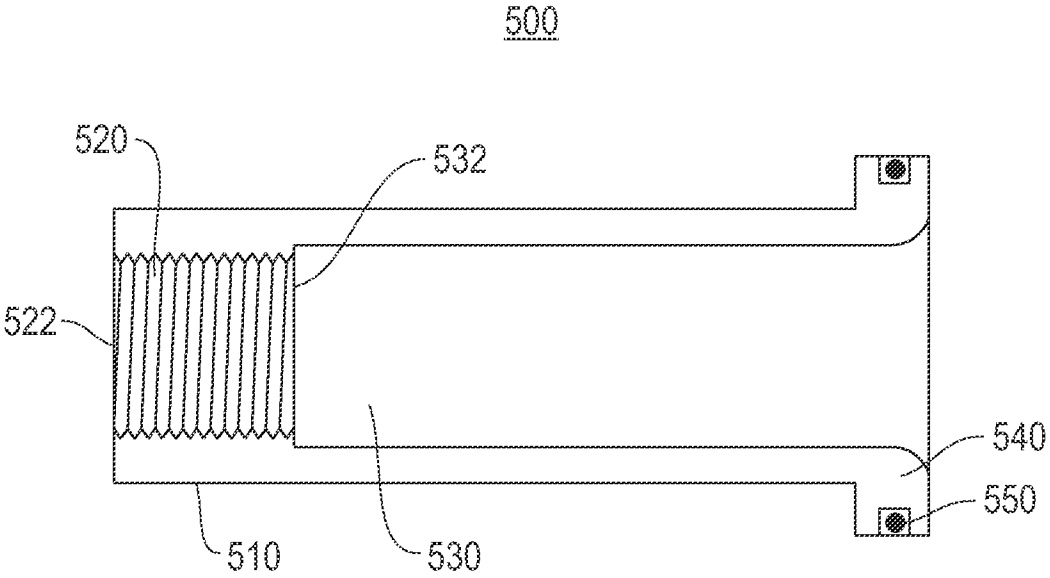
FIG. 5 is a sectional view of an inertial damping mechanism.

When applied to a semi-automatic, a silencer may cause an undesired inertial effect due to the inherent weight of the silencer. FIG. 5 is a sectional view of an inertial damping mechanism (500), which in one embodiment is configured to be attached to the silencer of FIG. 3. The inertial damping mechanism (500) includes a body (510) provided to isolate the negative inertial effect of the silencer. The body (510) is a piston with two sections, including a first section (520) and second section (530). The first section (520) is shown here with threading as an attachment element, and in one embodiment is employed to secured the body (510) to a projectile release device (not shown), such as a firearm. While the projectile release device is regarded as a firearm hereafter, it should be noted that the attachable projectile release device as described should not be limited as such. In one embodiment, the threaded surface of the first section (520) is configured to be threaded to a barrel of a firearm (not shown) having a corresponding threaded surface. The second section (530) is shown with a hollowed out interior. Accordingly, the body (510) is configured to be secured to the firearm at one end through an attachable apparatus.

The first section (520), includes a proximal end (522) and a distal end (524), and the second section (530) includes a proximal end (532), a distal end (534), and an exterior wall (536). As shown, for the first section (520), the proximal end (522) is configured to be in communication with a barrel of a firearm or an alternative projectile release device, and the distal end (524) is in communication with a proximal end (532) of the second section (530). The distal end (534) of the second section (530) includes a toric joint (540). The toric joint (540) functions to restrict gas within the suppressor from entering the inertial damping mechanism (500). Specifically, the toric joint (540) is molded to receive a toric ring (550) e.g. an o-ring. The toric ring (550) acts as a seal to force gas to exit distal of the inertial damping mechanism (500).

Figure 6:
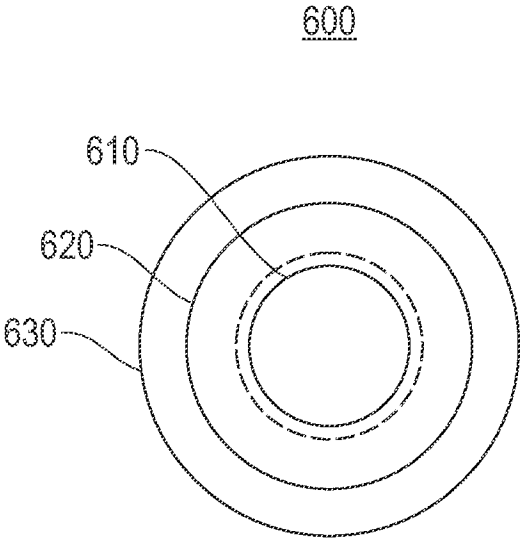
FIG. 6 is an end view of the inertial damping mechanism shown in FIG. 5.

FIG. 6 is an end view (600) of the inertial damping mechanism shown in FIG. 5. As shown, there are three concentric sections (610), (620), and (630). Starting from an interior portion of the inertial damping mechanism, the first concentric section (610) represents the annular shape of the first section (520). The second concentric section (620) represents the diameter of the inertial damping mechanism (500), and specifically, the diameter of the second section (530) with respect to the exterior wall (536). The third concentric section (630) represents the diameter of annular shape of the inertial damping mechanism (500) with respect to the position of the toric join (540). Accordingly, as shown herein, each of the components of the inertial damping mechanism have an annular representation and are aligned to form a path for travel of a projectile exiting the firearm, with the materials of the components functioning to mitigate any undesired inertial effect due to the inherent weight of a silencer in communication with the firearm.

Figure 7:
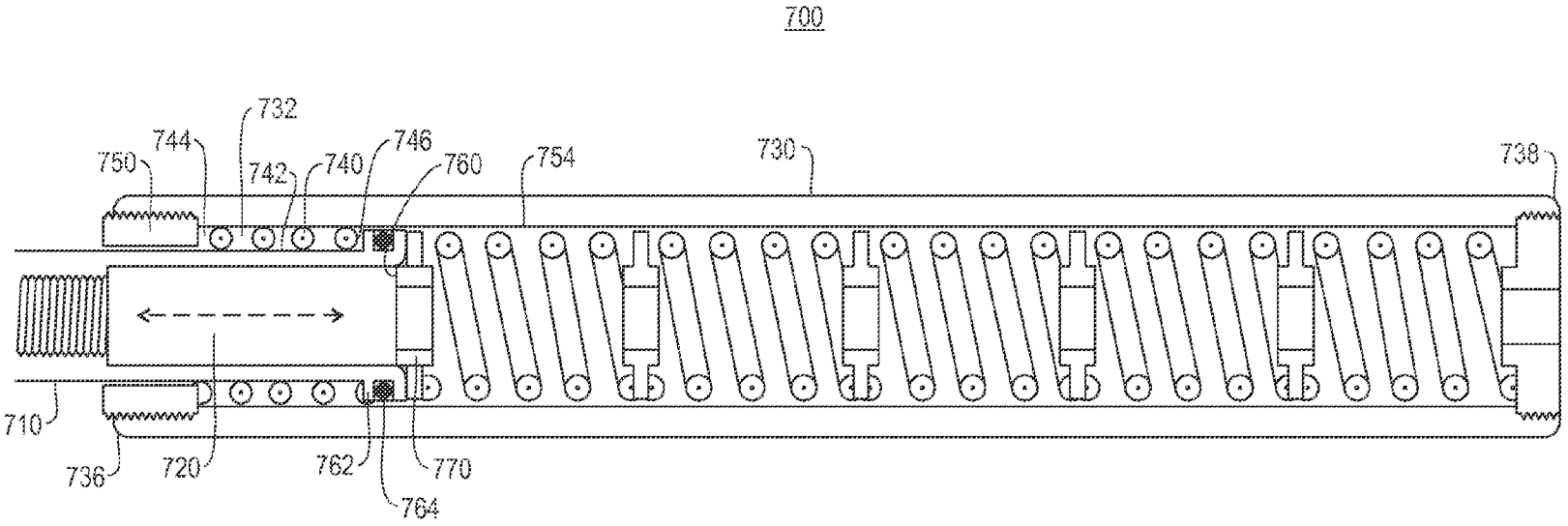
FIG. 7 is a sectional view of a damping apparatus secured to a suppressor.

The inertial damping mechanism is configured to secure to a firearm and to a suppressor, also referred to herein as a silencer. FIG. 7 is a sectional view (700) of the inertial damping mechanism (500) attached to a suppressor (730). When attached to a barrel of the firearm, the body (710) mimics a movement of the barrel, specifically in an axial direction. In one embodiment, the barrel of the firearm moves between an extended state and a contracted state and a change of state of the barrel is followed by a corresponding change of state of position of the body (710). The body (710) is partially inserted into the hollow of the suppressor (732) in a first position. A proportion of the body inserted within the suppressor (730) directly corresponds to a state of the firearm. Specifically, a change of state of the barrel of the firearm from an extended state to a contracted state results in a change of state of a position of the body (710) from a first position having a greater proportion of the body (710) inserted into the suppressor (730) to a second position having a lesser proportion of the body (710) inserted into the suppressor (730). Similarly, a change of state of the barrel from a contracted state to an extended state results in a change of state of the position of the body (710) from a second position having a lesser proportion of the body inserted into the suppressor (730) to a first position having a greater proportion of the body inserted into the suppressor (730). Accordingly, the movement and state of the body attached to the barrel directly corresponds with the movement and state of the barrel.

Axially variable material (740) is in communication with an external surface (742) of the body (710), and functions to absorb inertia generated by the barrel movement. In one embodiment, the axially variable material (740) is confined to a hollow of the suppressor (732) and is specifically confined to a first end (744) by a gland sleeve (750) and a second end (746) by a second side of the body (760). In one embodiment, the axially variable material is a spring (740), and compression of the spring, absorbs the generated inertia. The position of the body (710) has a direct relationship with a compression state of the spring (740). Specifically, the body (710) restricts the spring (740) to a first compressed state when in the first position, and enables the spring (740) to be in a second compressed state when in the second position. The first and second states pertain to different levels of compression. In the first state the spring is compressed in a naturally loaded state, and in the second state the spring is in a greater state of compression in comparison with the first state. In one embodiment, the second state takes place in response to expanding gases associated with movement of the projectile through the body. Transitively, the spring (740) is in the second compressed state when the barrel is in the extended state and is in the first compressed state when the barrel is in the contracted state. In one embodiment, the spring (740) returns to the first compressed state responsive to a projectile leaving the firearm. Accordingly, a change of state of the axially variable material (740) responsive to a change of state of the barrel causes the axially variable material (740) to absorb inertia generated by the change of state of the barrel.

As mentioned above, the axially variable material (740) is confined to the first end (744) by the gland sleeve (750) and is confined to the second end (746) by the second side of the body (760). The gland sleeve (750) is fixed to an interior wall of the hollow of the suppressor (732) and in addition to retaining the position of one end of the axially variable material (740), guides the body on the axial path (720) when the body (710) changes state. The second side of the body (760) restricts the position of the axially variable material (740) through an extended end (762), also referred to herein as the toric joint, that extends to an interior wall of the suppressor (754). The toric joint (762) provides additional functionality in that it restricts gas within the suppressor from entering the inertial damping mechanism (500). Specifically, the toric joint (762) is molded to receive a toric ring (764) e.g. an o-ring, and is adjacent to the second side of the body (760). The toric ring (764) acts as a seal to force gas to exit through a second side of the suppressor (738), and preventing gas from exiting through the hollow of the suppressor (732). Accordingly, a gland sleeve is provided to guide the body and restrict the position of the axially variable material about a first end and an extended end acts as a gas seal and restricts the position of the axially variable material about a second end.

The toric ring (764) is received by the toric joint (762), which is fixed to the second end (760) of the body (710). The toric joint (762) functions as a seal between the external surface (742) of the body (710) and the interior wall (754) of the suppressor (730), also referred to herein as a silencer. As referenced above, the toric joint (762) functions to restrict gas emission associated with travel along the projectile path toward a first end (736) of the suppressor (730), distal from the body (710). An annular partition (770) is provided adjacent to the second side (760) of the body (710). The partition (770) is sized to receive the toric joint (762). Accordingly, the toric joint (762) functions to enable the functionality of the sleeve in conjunction with the suppressor.

Figure 9:
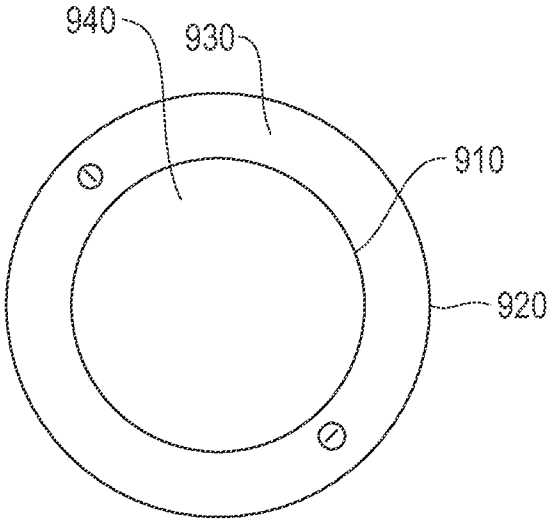
FIG. 9 is an end view of the sleeve shown in FIG. 8.
Figure 8:
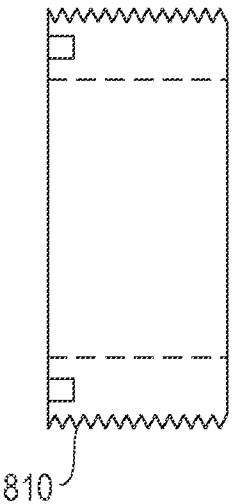
FIG. 8 is a sectional view of the gland sleeve.

FIG. 8 is a sectional view of the gland sleeve (800), hereinafter referred to as the sleeve, which in one embodiment is configured to limit movement of the axially variable material (740) with respect to the barrel of the firearm and the suppressor. As shown, the sleeve (800) has an annular shape with an exterior threaded surface (810) to secure the sleeve to the suppressor, and a concentric interior section (820) representing the path of the projectile. In one embodiment, the suppressor has a corresponding threaded interior wall that secured to the threaded surface (810), thereby securing the attachment of the sleeve (800) to the suppressor. FIG. 9 is an end view (900) of the sleeve shown in FIG. 8. As shown, there are two concentric sections (910) and (920). Starting from an interior portion of the sleeve, the first concentric section (910) represents the annular shape of the projectile path, and the second section (920) represents the width of the sleeve (900). In one embodiment, the sleeve is in the shape of a ring with a threaded exterior surface, and the distance (930) between the first and second sections (910) and (920) represents the width of the ring having a hollow interior (940).

Figure 11:
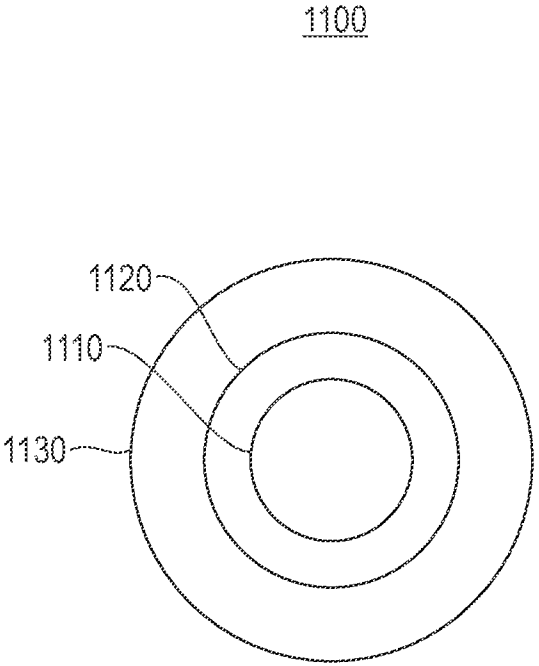
FIG. 11 is an end view of the partition shown in FIG. 10.
Figure 10:
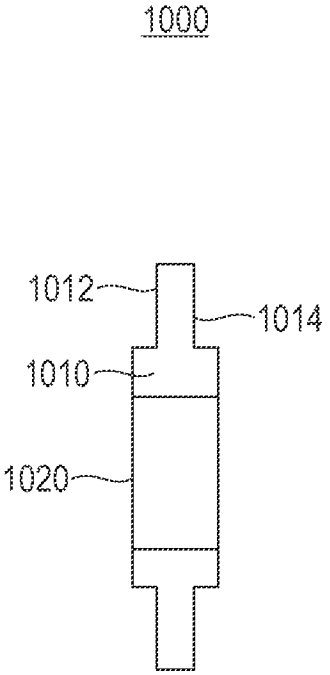
FIG. 10 is a sectional view of the annular partition.

As shown, an annular partition (770) is provided in communication with the inertial damping mechanism (500) and the inertial material of the suppressor. FIG. 10 is a sectional view of the annular partition (1000), hereinafter referred to as the partition. As shown, the partition (1000) has an annular shape with two sections (1010) and (1020). The second section (1020) is an interior section sized to receive the projectile (not shown), and in one embodiment is concentric with the projectile path provided in both the inertial damping mechanism and the suppressor. The first section (1010) extended from the second section (1020). In one embodiment, the second section (1020) is hollow, and the first section (1010) is comprised of a material. The first section (1010) is received by the toric joint on one side (1012) and by axially variable material of the suppressor on a second side (1014). FIG. 11 is an end view (1100) of the partition shown in FIG. 10. As shown, there are three concentric sections (1110), (1120), and (1130). Starting from an interior portion of the partition, the first concentric section (1110) represents the diameter of the projectile path, the second section (1120) represents the distance between the edge of the projectile path and the edge of the first section configured to receive the toric joint, and the third section (1130) represents the annular width of the toric joint.

Figure 12:
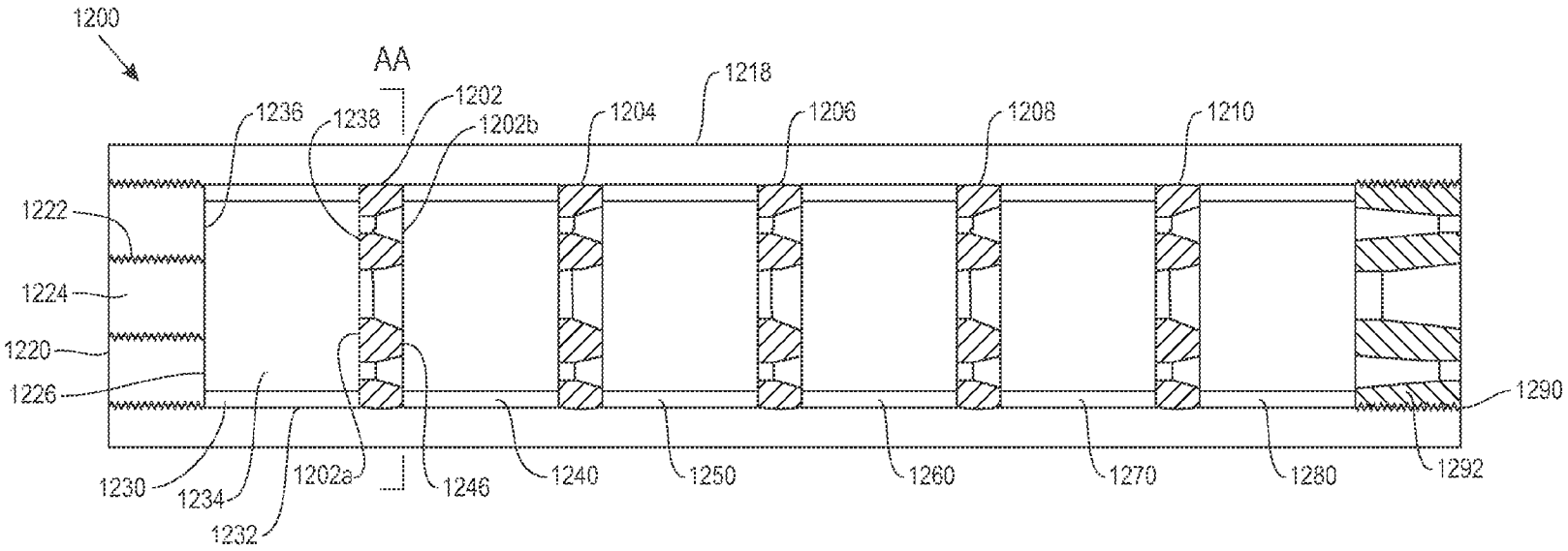
FIG. 12 is a sectional view of one embodiment of a noise suppressor for a firearm.

The embodiments shown in FIGS. 1-4 address noise suppression that incorporates dynamic volume chambers to absorb both sound and shock associated with the projectile. The dynamic volume chambers are in communication within a firearm. A noise suppressor for a firearm utilizing concepts of an additional embodiment is illustrated in FIG. 12. More specifically, FIG. 12 is a sectional view of one embodiment of a noise suppressor (1200) for a firearm. The suppressor includes an annular shaped body (1218) having a first end (1220) and a second end (1290). The first end (1220) includes a threaded interior wall (1222) configured to be secured to threads of a barrel of a firearm (not shown). In one embodiment, the first end (1220) may be alternatively configured and secured to the barrel of the firearm. The threaded interior wall (1222) is one embodiment that may be employed for securement. As shown, the threaded wall (1222) has an annular aperture (1224) that extends from the first end (1220) to an interior second end (1226). The size of the aperture is configured with a diameter that is greater than the diameter of a projectile exiting from the barrel of the firearm. In one embodiment, the aperture (1224) forms the proximal end of a projectile path. Accordingly, the threaded interior wall is configured to secure to the barrel of the firearm and sized to receive a projectile exiting the barrel.

The threaded interior wall (1222) is shown adjacent to the first end (1220) of the annular shaped body (1220). The second interior end (1226) of the threaded wall is adjacently positioned to a first static volume sleeve (1230). In the example shown herein, there are six sleeves (1230), (1240), (1250), (1260), (1270), and (1280). The first sleeve (1230) is adjacently mounted to the threaded wall (1222), and the fifth sleeve (1280) is mounted adjacent to a distal partition (1292) adjacent to the second end (1290). Each sleeve has a fixed volume set by the walls and length of the sleeve. Although five sleeves are shown, the invention should not be limited to this quantity. In one embodiment, the suppressor may be limited to two or more sleeves. Accordingly, multiple sleeves are provided within the body of the suppressor.

Each sleeve is identical, or relatively identical, to an adjacently mounted sleeve, and will be described herein with specificity with respect to the first sleeve (1230). As shown, sleeve (1230) has an annular shape with an annular wall (1232) and a hollow interior (1234). More specifically, each sleeve (1230) has a first end (1236) and a second end (1238). With respect to the first sleeve (1230), the first end (1236) is adjacent to and in communication with the threaded wall (1222) and the second end (1238) defines the distal boundary of the sleeve (1230). A partition (1202) is provided adjacent to the distal boundary of the sleeve (1230). The partition (1202) has two sides, including a first side (1202*a*) and a second side (1202*b*). The first side (1202*a*) is in communication with second end (1238) of the sleeve (1230), and the second side (1202*b*) is in communication with a first end (1246) of sleeve (1240). In one embodiment, when assembled, the sleeves hold an intermediate partition in a relatively fixed position.

Each adjacently positioned sleeve is separated by a partition. As shown in the configuration with six chambers there are five partitions (1202), (1204), (1206), (1208), and (1210). Each of the partitions has a similar arrangement with details illustrated and described below in FIGS. 6 and 7. In general, each partition has a central aperture and a plurality of exit ports. The central aperture forms a part of the projectile path. The one or more exit ports relieve pressure from gas released by the projectile. Furthermore, as shown, the suppressor is provided with a distal partition (1292), which is similarly configured to the interior partitions. Details of the distal partition (1292) are provided in FIG. 9.

Figure 13:
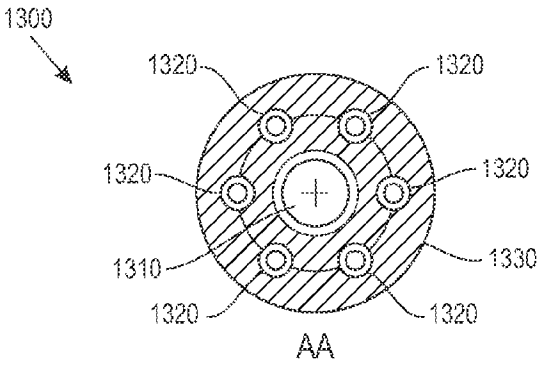
FIG. 13 is a top view of a partition for the suppressor shown in FIG. 12.

FIG. 13 is a top view of a partition (1300). As shown, the partition (1300) has a central aperture (1310) and a plurality of exit relief ports (1320) axially arranged. More specifically, the partition (1300) has a circular shape with a circumference sized to be received in the annular body of the suppressor. The central aperture (1310) is centrally disposed and has an opening that extends across the width of the partition (1300), e.g. from a proximal side to a distal side. The relief ports (1320) are axially arranged about the partition (1300) and positioned between the central aperture (1310) and the circumferential edge (1330). Similar to the central aperture (1310), each of the relief ports (1320) has an opening (1322) that extends across the width of the partition, e.g. from a proximal side to a distal side.

Figure 14:
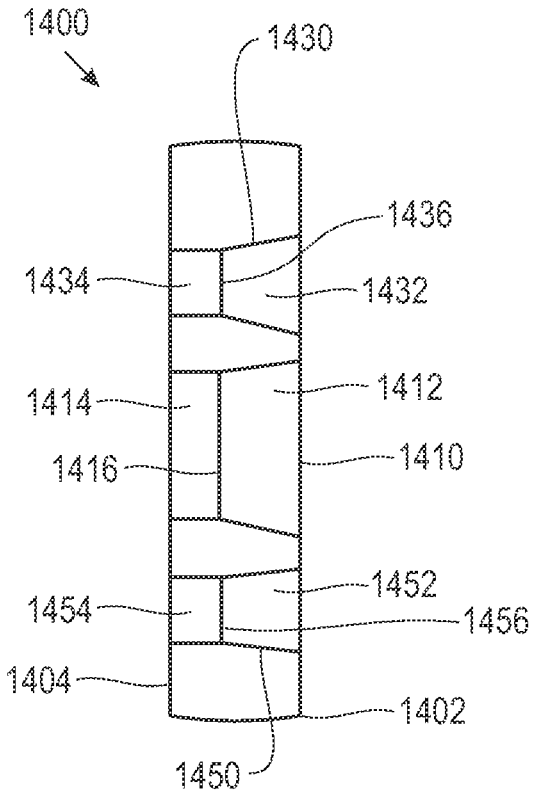
FIG. 14 is cross sectional view of one of the partitions for the suppressor shown in FIG. 12.

FIG. 14 is a cross sectional view (1400) of one of the partitions. As shown, the partition (1400) has a central aperture (1410) and two relief ports (1430) and (1450) visible on the cross section view. The central aperture (1410) forms part of the projectile path. As shown, the central aperture has two sections, including a first section (1412) that extends from the distal end (1402) and a second section (1414) that extends from the proximal end (1404). The first and second sections (1412) and (1414), respectively, meet at a juncture (1416). The configuration of the second section (1414) is cylindrical, extending from the proximal end (1404) to the juncture (1416). The configuration of the first section (1412) is conical, extending from the distal end (1402) to the juncture (1416). The conical configuration includes a wider opening of the central aperture (1410) adjacent to the distal end (1402), with the opening gradually tapering to a narrower opening adjacent to the juncture (1416).

Each of the relief ports (1430) and (1450) has a similar configuration to the central aperture (1410), although the relief ports each have a smaller opening when compared to the opening of the central aperture. Relief port (1430) has two sections, including a first section (1432) that extends from the distal end (1402) and a second section (1434) that extends from the proximal end (1404). The first and second sections (1432) and (1434), respectively, meet at a juncture (1436). In one embodiment, the first section (1432) has a length across the opening to the juncture (1436) that is greater than a length of the second section (1434) extending across the opening from the proximal end (1404) to the juncture (1436). The configuration of the second section (1434) is cylindrical, extending from the proximal end (1404) to the juncture (1436). The configuration of the first section (1432) is conical, extending from the distal end (1402) to the juncture (1436). The conical configuration includes a wider opening of relief port (1430) adjacent to the distal end (1402), with the opening gradually tapering to a narrower opening adjacent to the juncture (1436). Similar to relief port (1430), relief port (1450) has two sections, including a first section (1452) that extends from the distal end (1402) and a second section (1454) that extends from the proximal end (1404). The first and second sections (1452) and (1454), respectively, meet at a juncture (1456). The configuration of the second section (1454) is cylindrical, extending from the proximal end (1404) to the juncture (1456). The configuration of the first section (1452) is conical, extending from the distal end (1402) to the juncture (1456). The conical configuration includes a wider opening of relief port (1450) adjacent to the distal end (1402), with the opening gradually tapering to a narrower opening adjacent to the juncture (1456).

In FIG. 14 described above, only two relief ports are visible. This is the cross-sectional view presented. In one embodiment, there may be up to six relief ports annularly spaced about the partition. Furthermore, as shown in FIG. 14, both the central aperture (1410) and each of the relief ports (1430) and (1450) has a countersunk shape to the opening, e.g. a cylindrical opening adjacent to a conical opening. As the projectile travels along the projectile path and the gas byproduct is absorbed in the body of the suppressor, turbulence associated with the flow of the gas byproduct forms in the openings. The countersunk shape of the openings combats the turbulence of the fluid in the restricted aperture and causes slowing down of the fluid. Accordingly, the countersunk shape enables the fluid to pass through the relief ports at optimum speed.

Figure 15:
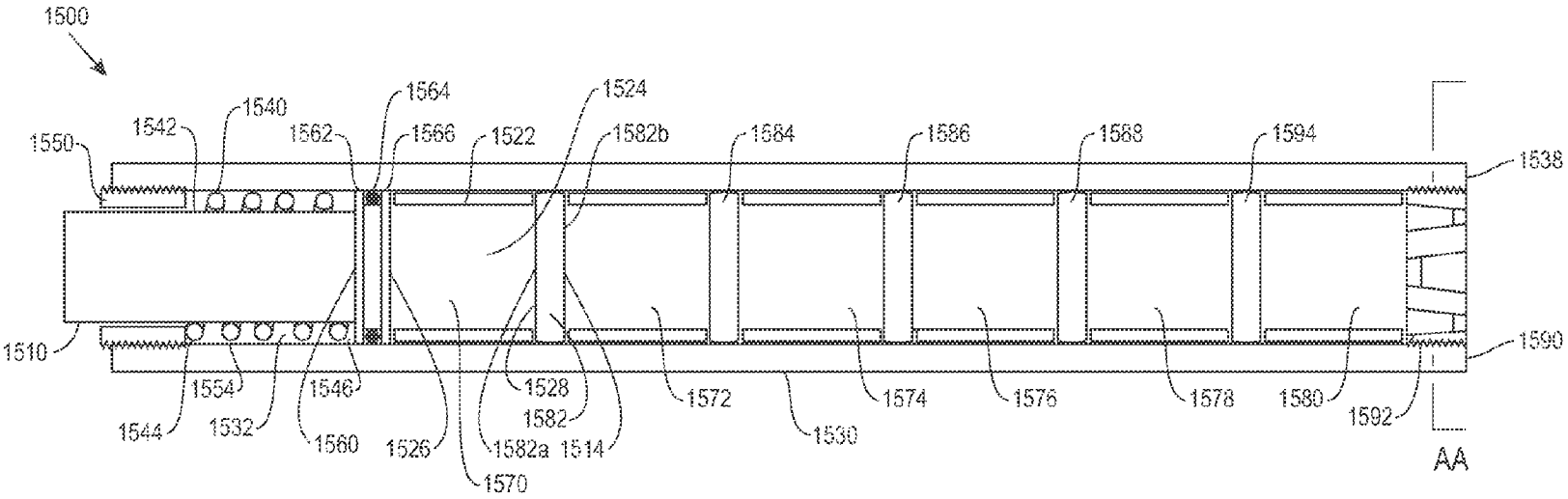
FIG. 15 is a cross section of the suppressor integrating the inertial damping mechanism with static volume chambers.

As shown in FIG. 12, an inertial damping mechanism is provided to integrate the firearm with the suppressor. FIG. 15 is a cross section of the suppressor (1500), which in one embodiment is configured integrating the inertial damping mechanism, hereinafter referred to as a piston, with the suppressor of FIG. 12 having static volume chambers. The piston (1510) is partially inserted into a hollow of the suppressor (1530) in a first position. A proportion of the body of the piston (1510) inserted within the suppressor (1530) directly corresponds to a state of the firearm. Specifically, a change of state of the barrel of the firearm from an extended state to a contracted state results in a change of state of a position of the piston (1510) from a first position having a greater proportion of the piston (1510) inserted into the suppressor (1530) to a second position having a lesser proportion of the piston (1510) inserted into the suppressor (1530). Similarly, a change of state of the barrel from a contracted state to an extended state results in a change of state of the position of the piston (1510) from a second position having a lesser proportion of the piston (1510) inserted into the suppressor (1530) to a first position having a greater proportion of the body inserted into the suppressor (1530). Accordingly, the movement and state of the piston attached to the barrel directly corresponds with the movement and state of the barrel.

Axially variable material (1540) is in communication with an external surface (1542) of the body (1510), and functions to absorb inertia generated by the barrel movement. In one embodiment, the axially variable material (1540) is confined to a hollow of the suppressor (1532) and is specifically confined to a first end (1544) by a gland sleeve (1550) and a second end (1546) by a second side of the body (1560). In one embodiment, the axially variable material is a spring (1540), and compression of the spring, absorbs the generated inertia. The position of the body (1510) has a direct relationship with a compression state of the spring (1540). Specifically, the body (1510) restricts the spring (1540) to a first compressed state when in the first position, and enables the spring (1540) to be in a second compressed state when in the second position. The first and second states pertain to different levels of compression. In the first state the spring is compressed in a naturally loaded state, and in the second state the spring is in a greater state of compression in comparison with the first state. In one embodiment, the second state takes place in response to expanding gases associated with movement of the projectile through the body. Transitively, the spring (1540) is in the second compressed state when the barrel is in the extended state and is in the first compressed state when the barrel is in the contracted state. In one embodiment, the spring (1540) returns to the first compressed state responsive to a projectile leaving the firearm. Accordingly, a change of state of the axially variable material (1540) responsive to a change of state of the barrel causes the axially variable material (1540) to absorb inertia generated by the change of state of the barrel.

The second side of the body (1560) restricts the position of the axially variable material (1540) through an extended end (1562) also referred to herein as the toric joint, which extends to an interior wall of the suppressor (1554). The toric joint (1562) provides additional functionality in that it restricts gas within the suppressor from entering the inertial damping mechanism (500). Specifically, the toric joint (1562) is molded to receive a toric ring (1564) e.g. an o-ring, and is adjacent to the second side of the body (1560). The toric ring (1564) acts as a seal to force gas to exit through a second side of the suppressor (1538), and preventing gas from exiting through the hollow of the suppressor (1532). Accordingly, a gland sleeve is provided to guide the body and restrict the position of the axially variable material about a first end and an extended end acts as a gas seal and restricts the position of the axially variable material about a second end.

A distal side (1566) of the toric joint (1562) is adjacently positioned to a first static volume sleeve (1570). In the example shown herein, there are six sleeves (1570), (1572), (1574), (1576), (1578), and (1580). The first sleeve (1572) is adjacently mounted to the toric joint (1562), and the sixth sleeve (1580) is mounted adjacent to a distal partition (1592) adjacent to the second end (1590). Each sleeve has a fixed volume set by the walls and length of the sleeve. Although four sleeves are shown, the invention should not be limited to this quantity. In one embodiment, the suppressor may be limited to two or more sleeves. Accordingly, multiple sleeves are provided within the body of the suppressor.

Each sleeve is identical, or relatively identical, to an adjacently mounted sleeve, and will be described herein with specificity with respect to the first sleeve (1570). As shown, sleeve (1570) has an annular shape with an annular wall (1532) and a hollow interior (1524). More specifically, each sleeve (1570) has a first end (1526) and a second end (1528). With respect to the first sleeve (1570), the first end (1526) is adjacent to and in communication with the toric joint (1562) and the second end (1528) defines the distal boundary of the sleeve (1570). A partition (1582) is provided adjacent to the distal boundary of the sleeve (1570). The partition (1582) has two sides, including a first side (1582*a*) and a second side (1582*b*). The first side (1582*a*) is in communication with second end (1528) of the sleeve (1570), and the second side (1582*b*) is in communication with a first end (1514) of sleeve (1572). In one embodiment, when assembled, the sleeves hold an intermediate partition in a relatively fixed position.

Each adjacently positioned sleeve is separated by a partition. As shown in the configuration with five chambers there are five partitions (1582), (1584), (1586), (1588), and (1594). Each of the partitions has a similar arrangement with details illustrated and described below in FIGS. 13 and 14. In general, each partition has a central aperture and a plurality of exit ports. The central aperture forms a part of the projectile path. The one or more exit ports relieve pressure from gas released by the projectile. Furthermore, as shown, the suppressor is provided with a distal partition (1588), which is similarly configured to the interior partitions. Details of the distal partition (1588) are provided in FIG. 9.

Figure 16:
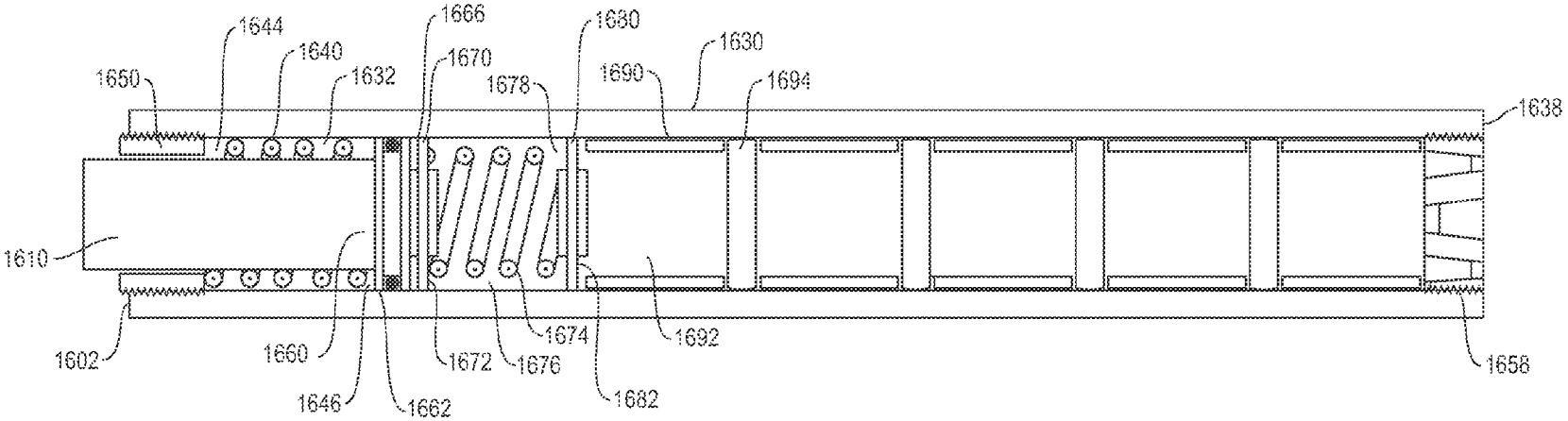
FIG. 16 is a cross section of the suppressor integrating the inertial damping mechanism with a dynamic volume chamber and a static volume chamber.

FIG. 16 is a is a cross section of the suppressor (1600), which in one embodiment is configured integrating the inertial damping mechanism, hereinafter referred to as a piston, with elements of the suppressor shown in FIGS. 1 and 12. As described above, the suppressor of FIG. 1 employs dynamic volume chambers, and the suppressor of FIG. 12 employs static volume chambers. The piston (1610) is partially inserted into a hollow of the suppressor (1630) in a first position. A proportion of the body of the piston (1610) inserted within the suppressor (1630) directly corresponds to a state of the firearm. The movement and state of the piston attached to the barrel directly corresponds with the movement and state of the barrel.

Axially variable material (1640) is in communication with an external surface (1642) of the body (1610), and functions to absorb inertia generated by the barrel movement. In one embodiment, the axially variable material (1640) is confined to a hollow of the suppressor (1632) and is specifically confined to a first end (1644) by a gland sleeve (1650) and a second end (1646) by a second side of the body (1660). In one embodiment, the axially variable material is a spring (1640), and compression of the spring, absorbs the generated inertia. The position of the body (1610) has a direct relationship with a compression state of the spring (1640). Specifically, the body (1610) restricts the spring (1640) to a first compressed state when in the first position, and enables the spring (1640) to be in a second compressed state when in the second position.

The second side of the body (1660) restricts the position of the axially variable material (1640) through an extended end (1662), also referred to herein as the toric joint. Details of the toric joint (1662) are shown and described in FIG. 7. The toric joint (1662) acts as a seal to force gas to exit through a second side of the suppressor (1638), and prevent gas from exiting through the hollow of the suppressor (1632).

A distal side (1666) of the toric joint (1662) is adjacently positioned to an annular partition (1670). Details of the annular partition (1670) are shown and described in FIG. 10. The annular partition (1670) is provided with an annular boss (1672) sized to receive a spring (1674) from an adjacently mounted dynamic volume chamber (1676). Details of the dynamic volume chamber are shown and described in FIG. 1. A distal end (1678) of the dynamic volume chamber (1676) is in communication with a distal annular partition (1680); with the distal annular partition (1680) being similarly configured to the annular partition (1670). Position adjacent to the distal annular partition (1680) is a static volume chamber (1690). Details of the static volume chamber (1690) are shown and described in FIG. 12. The interior (1692) of the static chamber (1690) is hollow, and the walls of the chambers are received by the annular boss (1682) of the distal partition (1680). The static volume chamber (1690) is received by a partition (1694). Details of the partition (1694) are shown and described in FIG. 12. In the example shown herein, there are five static volume sleeves adjacently positioned in the body (1630) from the proximal end (1602) to the distal end (1638), and a distal partition (1658) described in detail below in FIG. 17.

Figure 17:
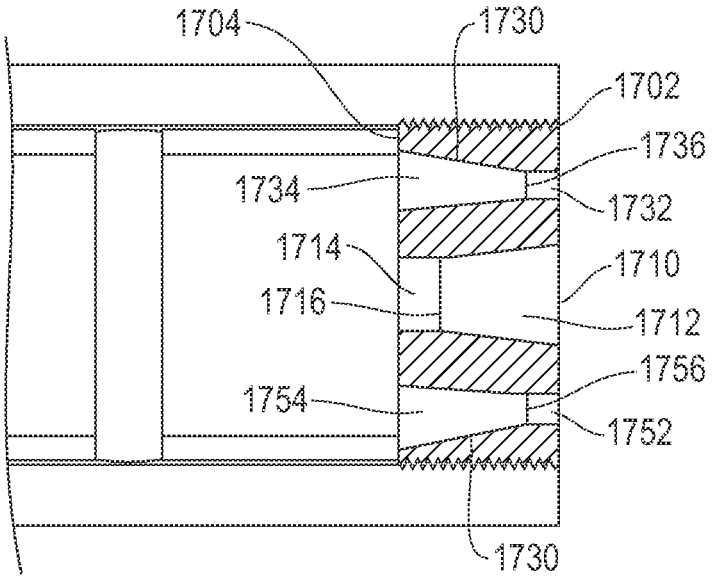
FIG. 17 is a cross-sectional view of the distal partition for the suppressor shown in FIG. 12.

The distal partition of the suppressor has a relatively inverse configuration to the internal partitions described in detail in FIGS. 6 and 7. FIG. 17 is a cross-sectional view (1700) of the distal partition. As shown, the partition (1700) has a central aperture (1710) and two relief ports (1730) and (1750) visible on the cross section view. In one embodiment, the distal partition may include up to eight relief ports. The central aperture (1710) forms part of the projectile path. As shown, the central aperture has two sections, including a first section (1712) that extends from the distal end (1702) and a second section (1714) that extends from the proximal end (1704). The first and second sections (1712) and (1714), respectively, meet at a juncture (1716). The configuration of the second section (1714) is cylindrical, extending from the proximal end (1704) to the juncture (1716). The configuration of the first section (1712) is conical, extending from the distal end (1702) to the juncture (1716). The conical configuration includes a wider opening of the central aperture (1710) adjacent to the distal end (1702), with the opening gradually tapering to a narrower opening adjacent to the juncture (1716). In one embodiment, the first section (1712) has a length across the opening to the juncture (1716) that is less than a length of the second section (1714) extending across the opening from the proximal end (1704) to the juncture (1716).

Each of the relief ports (1730) and (1750) has an inverse configuration in comparison to the central aperture (1710). The relief ports (1730) and (1750) each have a smaller opening when compared to the opening of the central aperture (1710). Relief port (1730) has two sections, including a first section (1732) that extends from the distal end (1702) and a second section (1734) that extends from the proximal end (1704). The first and second sections (1732) and (1734), respectively, meet at a juncture (1736). The configuration of the second section (1734) is conical, extending from the proximal end (1704) to the juncture (1736), with the widest portion of the conical shape adjacent to the proximal end (1704) and with the opening gradually tapering to a narrower opening adjacent to the juncture (1736). The configuration of the first section (1732) is cylindrical with a relatively uniform size extending from the distal end (1702) to the juncture (1736). Similar to relief port (1730), relief port (1750) has two sections, including a first section (1752) that extends from the distal end (1702) and a second section (1754) that extends from the proximal end (1704). The first and second sections (1752) and (1754), respectively, meet at a juncture (1756). The configuration of the second section (1754) is conical, extending from the proximal end (1704) to the juncture (1736), with the widest portion of the conical shape adjacent to the proximal end (1704) and with the opening gradually tapering to a narrower opening adjacent to the juncture (1736). The configuration of the first section (1752) is cylindrical with a relatively uniform size extending from the distal end (1702) to the juncture (1736).

Multiple partitions are arranged, with each interior partition separating adjacent sleeves, a proximal partition adjacent to a proximal end of the suppressor, and an exit partition adjacent to a distal end of the suppressor. In one embodiment, a size of the relief ports is uniform from the proximal end of the suppressor to the distal end of the suppressor. Similarly, in one embodiment, the size of the relief ports may be non-uniform from the proximal end to the distal end. In one embodiment, the size of the relief ports sequentially increases in size from the proximal end of the suppressor to the distal end of the suppressor, and in another embodiment, the size of the relief ports sequential decrease in size from the proximal end of the suppressor to the distal end of the suppressor. In one embodiment, the increase or decrease is between 0.005 to 0.020 inches in diameter for each successive relief port in the sequence. Similarly, in one embodiment, the size of the central aperture sequentially increases in size from the proximal end of the suppressor to the distal end of the suppressor, with the increase being about 0.008 inches in diameters for each successive central aperture in the sequence. Accordingly, in one embodiment, both the central aperture and the exit relief ports sequentially increase by about 0.008 inches in a distal direction across the length of the suppressor.

As described above, the sequential arrangement of the central apertures of the partitions forms the projectile release path through the suppressor. As the projectile travels the length of the suppressor via the projectile path, gas is released as a byproduct. The exit relief ports use the gas byproduct as an elastic medium within the body of the suppressor. More specifically, the exit relief ports relieve pressure from the gas in the sleeves that are separated by the partitions. The released gas bleeds backwards into the body, e.g. in a proximal direction, following exit of the projectile from the body of the suppressor. The exit relief ports function to equalize density of the gas within the body. Furthermore, the exit relief ports muffle an initial concussion associated with the projectile upon release from the distal end of the suppressor body, and at the same time mitigates flash from appearing upon exit of the projectile from the distal end.

Figure 18:
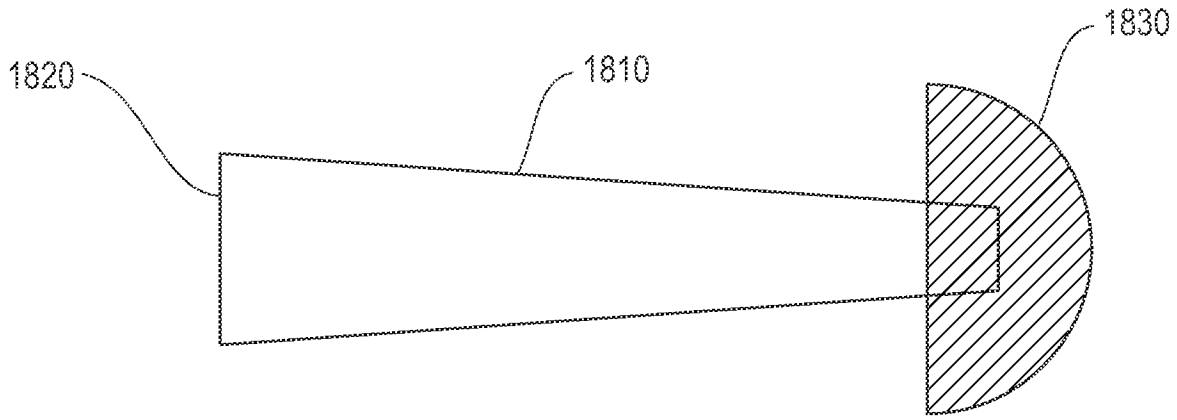
FIG. 18 is a block diagram of a side view of a linear alignment tool employed to align the relief ports along the length of the suppressor shown in FIG. 12.

As described above, each of the sleeves in the suppressor are identical or nearly identical. However, the partitions within the suppressor are different, although with similar configurations. The size of the openings of the central aperture and the relief ports sequentially increases in the distal direction. To support proper assembly of the sleeves and partitions, the sleeves may be provided with indicia. In one embodiment, the indicia may be in the form of a number, with the multiple partitions sequentially numbered to ensure proper assembly. In addition to the sequential arrangement of the partitions, it is desirable that the relief ports of adjacently positioned partitions to align. FIG. 18 is a block diagram of a side view of a linear alignment tool (1800) employed to align the relief ports along the length of the suppressor. As shown, the tool (1800) includes a body (1810) with a proximal end (1820) and a distal end (1830). The body (1810) is tapered so that the cross-section of the body decreases along the length from the proximal end (1820) to the distal end (1830). This configuration enables the partitions to be inserted around the tool (1800), or in one embodiment, the tool to be inserted through the distal end of the suppressor as a measurement of proper sequential alignment of the partitions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Accordingly, the scope of protection of this invention is limited only by the claims and their equivalents.

I claim:

1. An apparatus comprising:

a body defining a housing in communication with a muzzle end of a firearm, the body having a first end and a second end, the first end adaptively secured to a muzzle end of a projectile release device, and the second end oppositely disposed;

the housing defining a hollow interior surrounding a path along which a projectile can travel;

the housing comprising:

two or more sleeves, including a first sleeve having a proximal end and a distal end, the proximal end in communication with the muzzle and the distal end in communication with a proximal end of a first partition, and a second sleeve having a proximal end and a distal end, the proximal end of the second sleeve in communication with a distal end of the first partition, and the distal end of the second sleeve in communication with an exit partition;

the first partition having a central aperture and a plurality of pressure relief ports axially disposed, the central aperture being a part of the projectile path;

the exit partition forming the second end of the body, the exit partition having a central aperture being a part of the projectile path, and a plurality of exit partition relief ports axially disposed;

the exit relief ports being a plurality of apertures that extend from a proximal end of the partition to a distal end of the partition; and the exit relief ports being tapered with a proximal end of the relief port being adjacent to the proximal end of the exit partition, and a distal end of the relief port being adjacent to the distal end of the exit partition, and the proximal end of the port having a proximal aperture in communication with a distal aperture of the port, including the distal aperture being larger than the proximal aperture.

2. The apparatus of claim 1, further comprising the relief ports of each of the partitions being tapered.

3. The apparatus of claim 1, further comprising the central aperture of the distal side of the exit partition being tapered, including the central aperture having a proximal aperture in communication with a distal aperture, including the distal aperture being larger than the proximal aperture.

4. The apparatus of claim 2, further comprising the exit ports of the partitions being sequentially tapered in a distal direction, wherein the distal aperture of the ports increase sequential from the first partition to the exit partition.

5. The apparatus of claim 2, wherein a size of the exit ports allows for deflection of a passing projectile.

6. The apparatus of claim 2, further comprising the central aperture of the exit partition having an opening greater than the central aperture of the first partition.

7. The apparatus of claim 1, further comprising the projectile to release gas as it travels along the path, and the exits ports using the gas as an elastic medium within the body.

8. The apparatus of claim 6, further comprising the exit ports to relieve pressure from the gas in the sleeves, including the released gas to bleed backwards into the body following exit of the projectile from the body, and the exit ports to equalize gas density within the body.

9. The apparatus of claim 7, further comprising the exit ports to muffle initial concussion associated with the projectile upon release from the second end of the body.

10. The apparatus of claim 7, further comprising the exit ports to mitigate flash from appearing upon exit of the projectile from the second end of the body.

11. The apparatus of claim 1, further comprising the sleeve to hold the partition in a relatively fixed position.

12. The apparatus of claim 1, further comprising aligning the relief ports of the first partition and the exit partition, including extending a linear alignment tool having a tapered body with a decreasing cross-section extending from a proximal end of the body to a distal end of the body.

13. An apparatus comprising:

a body defining a housing in communication with a muzzle end of a firearm, the body having a first end and a second end, the first end adaptively secured to a muzzle end of a projectile release device, and the second end oppositely disposed;

the housing defining a hollow interior surrounding a path along which a projectile can travel;

the housing comprising:

two or more sleeves, including a first sleeve having a proximal end and a distal end, the proximal end in communication with the muzzle and the distal end in communication with a proximal end of a first partition, and a second sleeve having a proximal end and a distal end, the proximal end of the second sleeve in communication with a distal end of the first partition, and the distal end of the second sleeve in communication with an exit partition;

the first partition having a central aperture and a plurality of pressure relief ports axially disposed, the central aperture being a part of the projectile path;

the exit partition forming the second end of the body, the exit partition having a central aperture being a part of the projectile path, and a plurality of exit partition relief ports axially disposed;

an alignment of the relief ports of the first partition and the exit partition, including a linear alignment tool having a tapered body with a decreasing cross-section extending from a proximal end of the body to a distal end of the body.

14. The apparatus of claim 13, further comprising the sleeve to hold the partition in a relatively fixed position.

15. The apparatus of claim 13, further comprising the projectile to release gas as it travels along the path, and the exits ports using the gas as an elastic medium within the body.

16. The apparatus of claim 15, further comprising the exit ports to relieve pressure from the gas in the sleeves, including the released gas to bleed backwards into the body following exit of the projectile from the body, and the exit ports to equalize gas density within the body.

17. The apparatus of claim 15, further comprising the exit ports to muffle initial concussion associated with the projectile upon release from the second end of the body.

18. The apparatus of claim 15, further comprising the exit ports to mitigate flash from appearing upon exit of the projectile from the second end of the body.

* * * * *